US006259006B1

(12) United States Patent
Parienti

(10) Patent No.: US 6,259,006 B1
(45) Date of Patent: Jul. 10, 2001

(54) PORTABLE FOLDABLE ELECTRONIC PIANO

(76) Inventor: Raoul Parienti, 5, Rue de Belgique, 06000 Nice (FR)

( * ) Notice: Subject to any disclaimer, the term of this patent is extended or adjusted under 35 U.S.C. 154(b) by 0 days.

(21) Appl. No.: 09/068,031

(22) PCT Filed: Aug. 30, 1996

(86) PCT No.: PCT/FR96/01335

§ 371 Date: Apr. 30, 1998

§ 102(e) Date: Apr. 30, 1998

(87) PCT Pub. No.: WO97/08681

PCT Pub. Date: Mar. 6, 1997

(51) Int. Cl.[7] ..... G10D 15/00

(52) U.S. Cl. ..... 84/171; 84/427; 84/423 R; 84/424

(58) Field of Search ..... 84/423 R, 427, 84/424, 431, 432, 619, 620, 741, DIG. 1, DIG. 3, DIG. 7, DIG. 27, 171; 446/71, 143, 168, 431

(56) References Cited

U.S. PATENT DOCUMENTS

| | | | | |
|---|---|---|---|---|
| 2,821,878 | * | 2/1958 | Stibitz | 84/1.01 |
| 2,888,517 | * | 5/1959 | Lindridge | 179/1 |
| 3,091,454 | * | 5/1963 | Sam | 273/1 |
| 3,643,000 | * | 2/1972 | Andersen | 84/1.01 |
| 3,698,276 | * | 10/1972 | Martin et al. | 84/365 |
| 3,778,525 | * | 12/1973 | Chase et al. | 84/1.25 |
| 3,823,245 | * | 7/1974 | Suzuki | 84/1.04 |
| 3,895,555 | * | 7/1975 | Peterson et al. | 84/470 |
| 4,350,070 | * | 9/1982 | Bahu | 84/1.03 |
| 4,469,000 | * | 9/1984 | Fujiwara et al. | 84/115 |
| 4,615,252 | * | 10/1986 | Yamauchi et al. | 84/1.1 |
| 4,668,843 | * | 5/1987 | Watanabe et al. | 200/5 A |
| 4,706,536 | * | 11/1987 | Sanders | 84/1.01 |
| 5,463,925 | * | 11/1995 | Galocy | 84/423 R |
| 5,507,215 | * | 4/1996 | Lin | 84/423 R |
| 5,616,897 | * | 4/1997 | Weber et al. | 200/5 |
| 5,656,789 | * | 8/1997 | Nakada et al. | 84/477 R |

FOREIGN PATENT DOCUMENTS

| | | | |
|---|---|---|---|
| 3143053 A1 | * | 5/1983 | (DE) . |
| 2454149 | * | 12/1980 | (FR) . |
| 2287499 | * | 11/1990 | (JP) . |

* cited by examiner

*Primary Examiner*—Robert E. Nappi
*Assistant Examiner*—Kim Lockett
(74) *Attorney, Agent, or Firm*—James C. Lydon

(57) ABSTRACT

Portable and foldable modular electronic keyboard which includes a keyboard having a plurality of white and black keys capable of reproducing the notes of a piano through an individual headphone by using associated electronics. The foldable keyboard is formed from a plurality of modules, each module having a plurality of white and black keys, and each module being joined to another module by a flexible membrane. When the modules are folded together, the keyboard has the volume of a book. When the modules are unfolded, the keyboard presents a genuine piano keyboard with seven octaves. The white keys and the black keys forming each module have a low thickness.

12 Claims, 5 Drawing Sheets

PORTABLE FOLDABLE ELECTRONIC PIANO

This invention relates to electronic devices for producing musical sounds. More particularly, the present invention relates to a portable and foldable modular electronic piano.

BACKGROUND OF THE INVENTION

Though the world of music is full of pleasure, musicians must play regularly and assiduously. A pianist for example, even an amateur, must practice almost everyday in order to keep his fingers nimble and to achieve and maintain perfect control of the keyboard.

Now, whereas a harmonica player or a violinist can carry their instrument, a pianist faces real difficulty in transporting his piano.

Of course, electronic keyboards which are easier to carry than a piano have appeared. However, existing models are still cumbersome, even though they only have a four-octave or five-octave keyboard. For example, German patent 9208106 discloses a keyboard capable of being folded in two parts, thus enabling easier transport, but the features of this keyboard (weight, size, operating mode) are still identical to those of existing keyboards that typically have only five octaves.

SUMMARY OF THE INVENTION

An object of the invention is to provide an ultra-light, foldable and unfoldable piano keyboard which is easy to carry.

Another object is to provide a foldable keyboard having the 7 octaves of a genuine piano keyboard.

Yet another object is to provide a portable keyboard whose size, once folded, is not higher than that of a book and, once unfolded, provides everyone an inexpensive means to practice with an instrument whose tone is similar to that of a real piano.

An advantage of the present invention is that it permits easy practice at all times because, once unfolded, the keyboard is similar to a real piano keyboard.

DETAILED DESCRIPTION OF THE PREFERRED EMBODIMENTS

Figure 1:
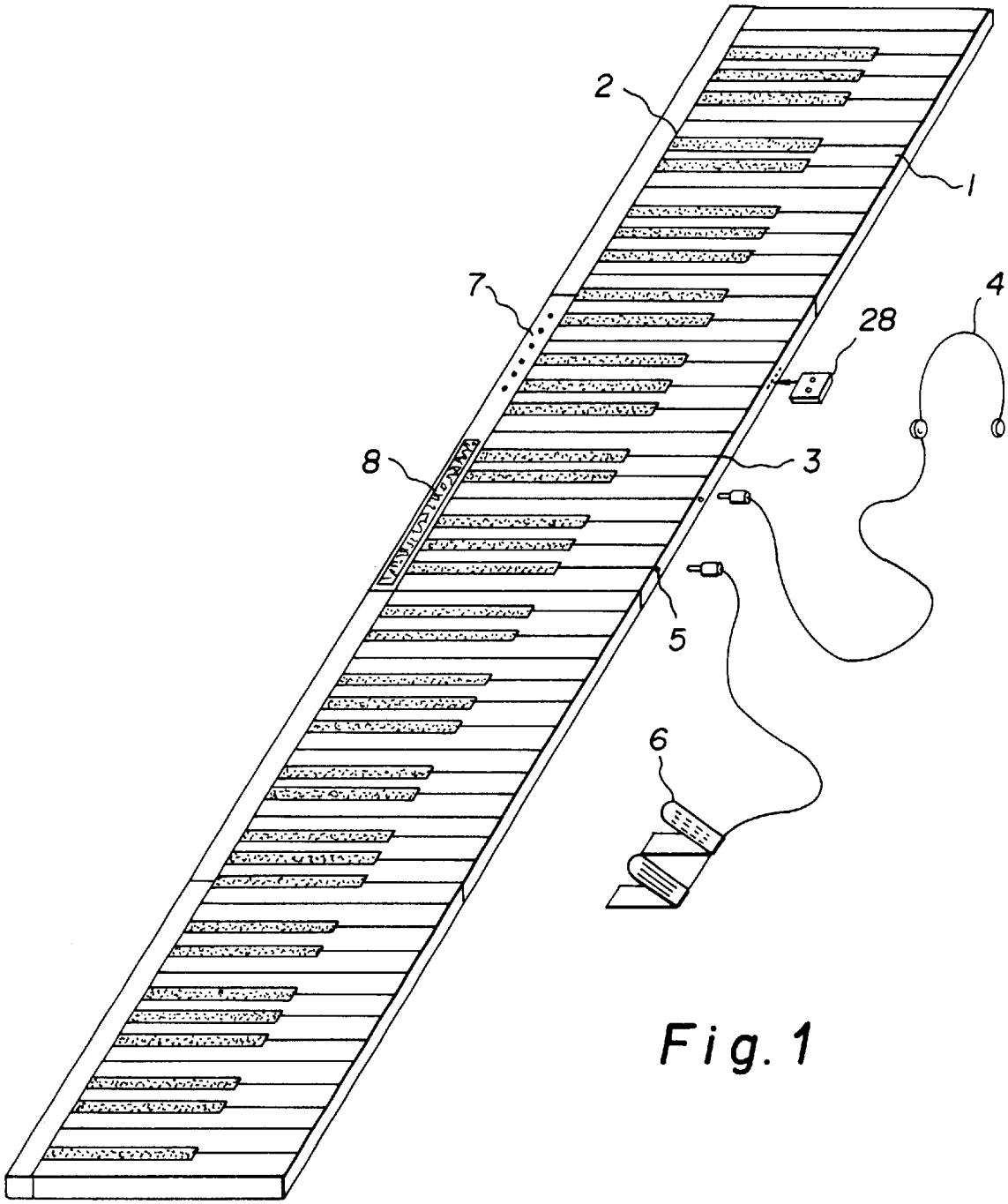
FIG. 1 shows a keyboard ready for operation.
Figure 2:
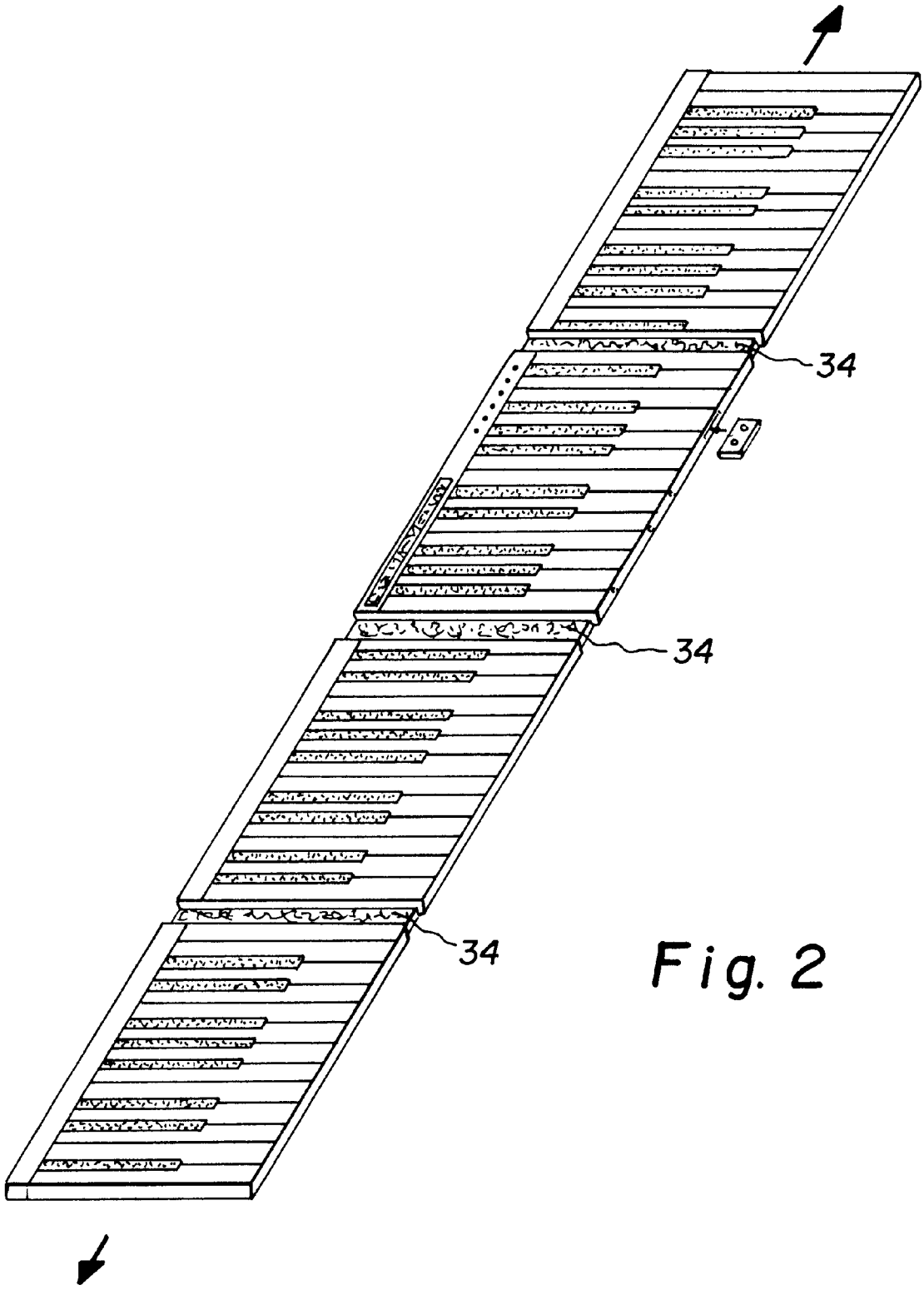
FIG. 2 shows an exploded view of the keyboard showing 4 modules to highlight the flexible membrane that makes them interdependent and appears when the keyboard is subjected to a traction force.
Figure 3:
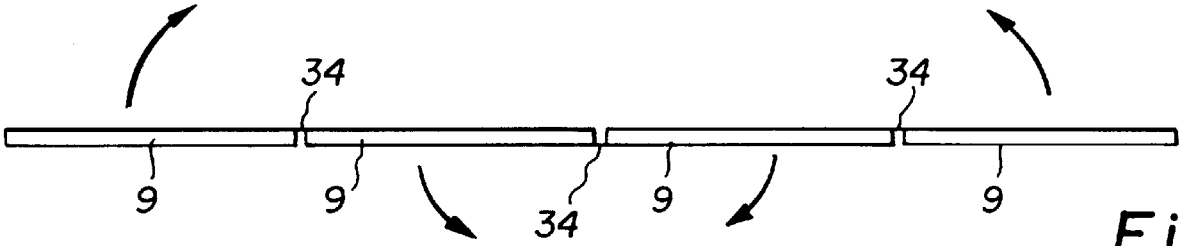
FIG. 3 is a cross-sectional view of the keyboard that shows one possible folding mode.
Figure 5:
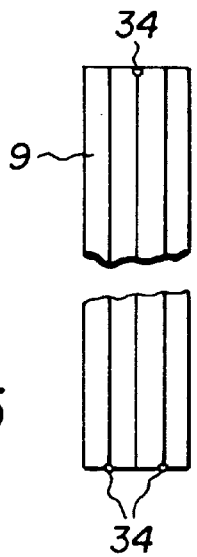
FIG. 5 shows a simplified view of the folded keyboard.
Figure 4:
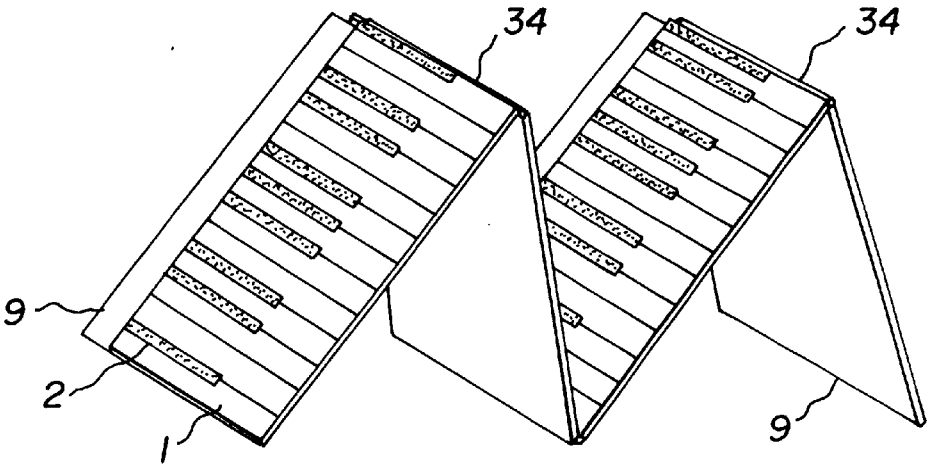
FIG. 4 shows the keyboard being folded according to a different folding mode.
Figure 10:
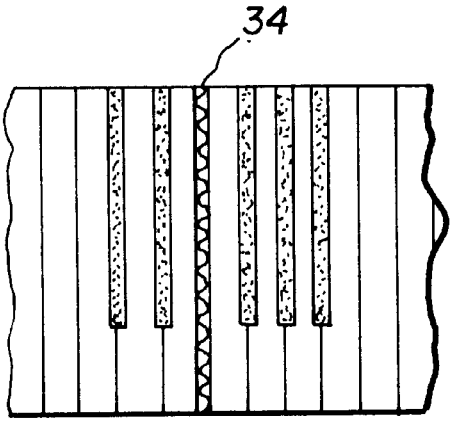
FIG. 10 illustrates the flexible membrane which joins the modules of the electronic keyboard together.

As shown in FIG. 1, the keyboard comprises white keys (1) and black keys (2) for semitones like real pianos. As illustrated by FIGS. 2 and 10, the keyboard consists of four modules (9) made interdependent upon each other by a flexible membrane (34) made of materials such as rubber, latex or plastic, that can mechanically withstand the strains produced by folding/unfolding operations. In one embodiment, modules (9) are solid and reproduce the white keys (1) and the black keys (2) through a slight raised pattern. According to another embodiment of the invention, the modules (9) forming the keyboard are made of independent mechanical keys spaced from one another by a gap that helps separate them, like a real piano keyboard.

In order to reduce overall dimensions and weight, the white keys (1) and the black keys (2) that make up each module (9) have a low thickness but form a true piano keyboard. The semitone black keys (2) are also embossed for proper ergonomics.

Of course, each key will match a piano sound, which can either be digitized from a real piano sound and stored in an appropriate memory, or played by a synthesizer. When these keys are hit, a piano sound will be reproduced through individual earphones. The depression of the keys required to trigger the sound generator may be calibrated so that merely placing a finger on the keyboard does not produce any sound. Instead, a piano sound will be reproduced only when the keyboard keys (1) and (2) are hit.

Figure 7:
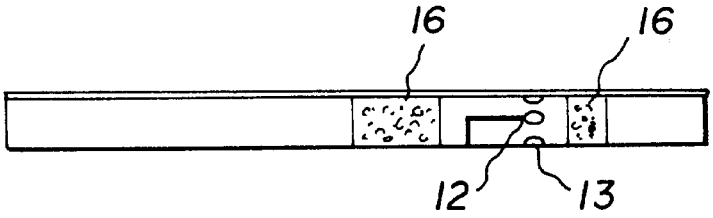
FIG. 7 depicts an embodiment of the keyboard having an elastic foam which urges the keys of the keyboard back to their open position.
Figure 9:
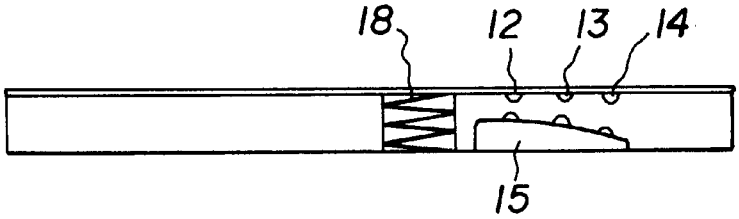
FIG. 9 illustrates an embodiment of the keyboard having three contacts located under a key for providing three possible sound levels.

Under each key there is one or several contacts: a single contact for a single sound level (all or nothing), two contacts for two possible sound levels, three or more contacts for three sound levels or more, as illustrated in FIG. 9. The contacts can be lined up with the vertical axis or be arranged along a template (15). As depicted in FIGS. 7 and 9, an elastic foam (16) or a spring (18) are used to push back the keys.

Figure 8:
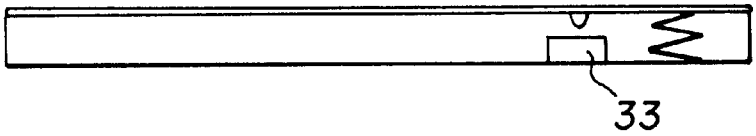
FIG. 8 illustrates an embodiment of the keyboard having a piezoelectric contact located under a key.

The contacts can be made with ink (inexpensive), capacitive, resistive, or better piezoelectric (33) technology, as shown in FIG. 8. In that case, the variable mechanical energy of the hit creates a correlative current capable of generating a plurality of nuances. The whole set of contacts is connected to an electronic unit having a sound synthesizer.

Figure 11:
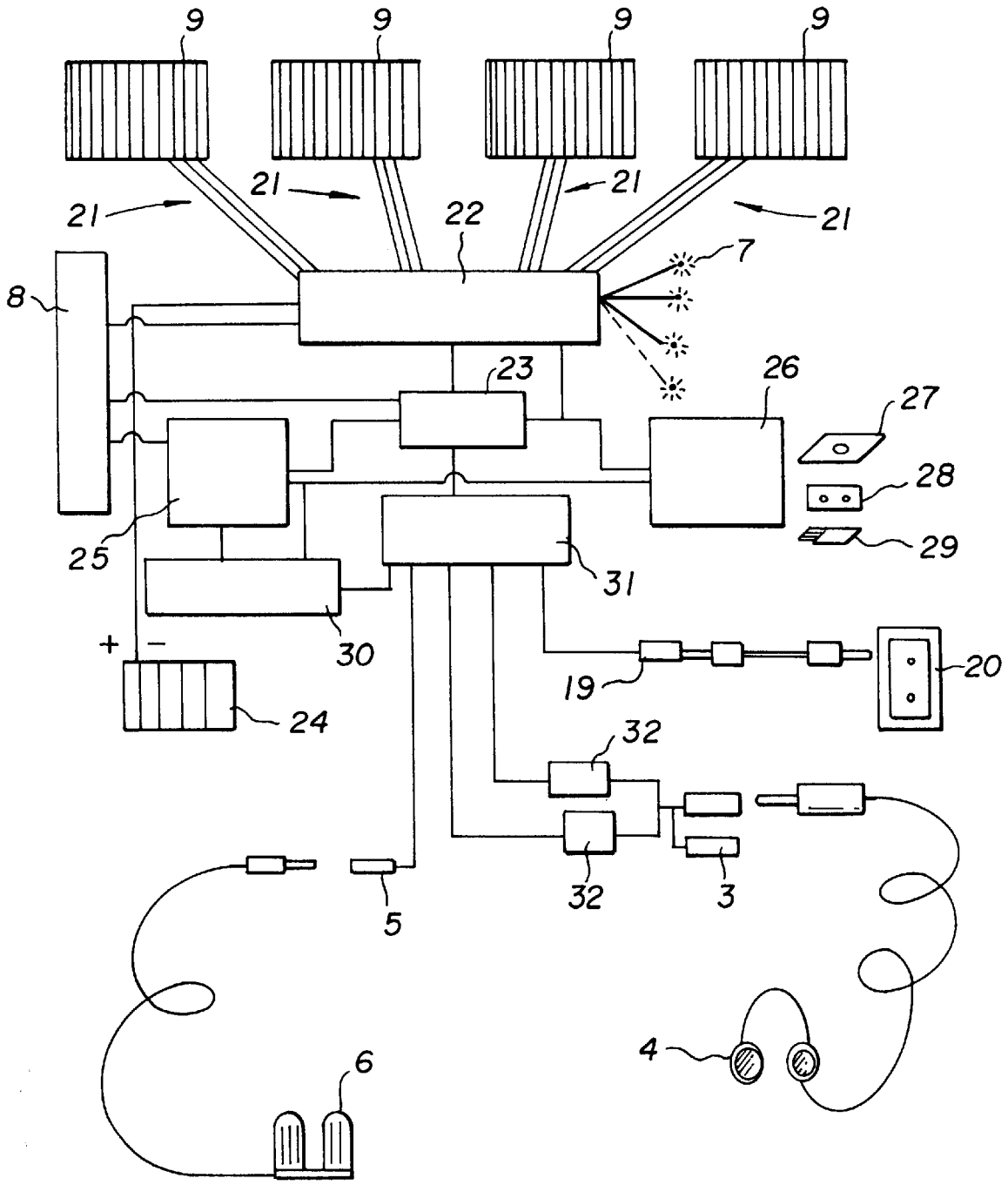
FIG. 11 shows a circuit for operation of the electronic keyboard of the present invention.

Each contact creates a signal and each signal is sent through an electrical wire. As illustrated in FIG. 11, all these wires are linked to a flexible strip (21) connected to a hardwired logic circuit (22) controlled by a microprocessor (23). The number of wires contained in said strip can be limited to reduce wiring costs. Electrical power may be supplied by means of standard or storage batteries (24), or by the mains through an A/C adapter.

In one embodiment, the piano sounds played when hitting keys (1) and (2) are digitized sounds from a real piano, stored within memory (25). Thus, microprocessor (23) controls a memory package (25) comprising ROM memory to store permanent data, like piano digitized sounds, and RAM memory that stores, for instance, the records of music sections just played. It is to be noted that specific circuits integrating the whole electronics set forth can be found, including 32-channel polyphonic microprocessors.

According to another embodiment, piano sound signals are produced by a synthesizer (30). The piano sound signals are then amplified by means of a preamplifier (31) and distributed to two headphones outputs (3). In a specific version of this embodiment, synthesizer (30) can be designed so as to reproduce the tones of several instruments.

The electric keyboard of the present invention typically has neither speakers nor sound amplifier circuits in order to reduce its overall dimensions and weight. The provision of two headphones sockets will enable a trainee and a teacher to listen at the same time.

A right/left stereo effect is achieved by means of two progressive ramp filters (32). One filter softens the treble for the left channel, thus giving priority to the bass, the other one, on the contrary, reduces the bass, thus giving priority to the treble for the right channel. This simple and inexpensive device helps produce the spatial sound effect of a piano.

A pedal socket (5) may be used to connect a pair of pedals (6) to the electronic keyboard. The effect of pedal operation is rendered through action on the preamplifier, the right pedal being used to extend a sound and the left pedal being used to soften it.

The electronic keyboard of the present invention may include an interface (26) for external memory devices such as disks (27), microcassettes (28) or plug-in memory modules (29), as illustrated in FIG. 11. These devices can be purchased later and can store scores, a piano training method, etc.

As shown in FIG. 1, another embodiment of the invention can integrate a screen (8) for displaying useful information to the user, such as the scrolling of a score. As shown in FIG. 11, screen (8) is controlled by microprocessor (23) and is connected to memory (25) and to hardwired logic circuit (22), so that the whole data can be stored either into the memory (25), or into external memory devices (27), (28), (29).

FIG. 1 also illustrates that the electronic keyboard can also be provided with LEDs (7) that light up as needed, for example to tell the musician what key is to be pressed. The whole set of LEDs (7) is controlled by the hardwired logic circuit (22) and the control signals of said LEDs are sent through the flexible strip (21) that integrates the wires. See FIG. 11.

The invention can also be provided with an output for connecting an amplifier or a hi-fi system, and with a MIDI output for connecting the invention to a computer.

According to another embodiment of the invention, a female socket (19) can receive acoustical signals from a personal stereo (20), an extension cord linking the personal stereo headphones output to the socket (19), said signals being managed by the preamplifier (31) and mixed with the piano sound signals to be sent to headphones (4). See FIG. 11. This embodiment is useful for a training method.

Figure 6:
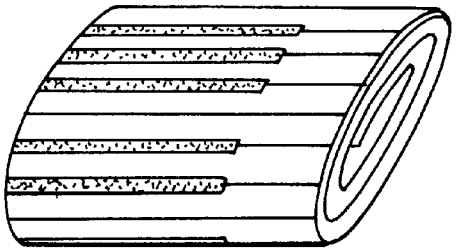
FIG. 6 illustrates the keyboard in a wound rather than folded mode.

According to another embodiment, the keyboard is fully flexible and permits easy folding with no joint. It is even better when the electronic keyboard can be wound upon itself, as illustrated by FIG. 6. Flexible circuits have been developed which enable such an embodiment.

The integration and the association of the various items that make up the invention enable to offer both the general public and the musician a new portable and original means for initiating and training oneself at low cost without bothering the neighbors.

The small size and low weight of the keyboard make it a true portable instrument that can be taken systematically by the pianist into his or her satchel for regular practice.

Another significant advantage of the electronic keyboard of the present invention is that, through the use of headphones, it does not produce any noise likely to bother the neighbors while enabling the pianist to continue practicing, even when on the move.

The shapes, dimensions and arrangement of the various items, as well as materials used for the manufacturing, such as hardened paper, cardboard, plastic, composite materials, etc., may vary without departing from the spirit of the invention set forth above.

What is claimed is:

1. A portable, foldable modular electronic piano, comprising i) a device for generating electrical signals corresponding to the notes of a piano, which device includes a preamplifier;

ii) a plurality of modules, with each module comprising a plurality of white keys and black keys operatively connected to said device; and iii) at least one flexible membrane which joins the modules together, wherein the membrane is sufficiently flexible to permit the modules to be folded over one another when not in use, and unfolded when the keyboard is to be used, such that when unfolded, the plurality of modules simulates a piano keyboard having seven octaves, iv) a plurality of contacts operatively connected to and located under each key so as to permit selection of a particular sound level from a number of sound levels corresponding to the number of said contacts, wherein said contacts comprise piezoelectric contacts which generate a current corresponding to an amount of mechanical energy exerted upon a corresponding key, and wherein said device is contained within said plurality of modules.

2. The electronic piano of claim 1, wherein said keys of each module comprise a slight raised pattern, with said black keys being embossed.

3. The electronic piano of claim 1, wherein each key is spaced from the other keys by a slot.

4. The electronic piano of claim 1, wherein said plurality of contacts are arranged along a template.

5. The electronic piano of claim 1, wherein said device further comprises a memory, and said notes of a piano comprise digitized sounds from a real piano which are stored into said memory.

6. The electronic piano of claim 1, wherein said device further comprises two headphones sockets operatively connected to said preamplifier.

7. The electronic piano of claim 6, further comprising two progressive ramp filters operatively located between said headphones sockets and said preamplifier, wherein one filter softens the treble for a left channel, thus giving priority to the bass, and the other one, on the contrary, reduces the bass, thus giving priority to the treble for a right channel, so as to be capable of producing a stereo effect.

8. The electronic piano of claim 7, wherein said device further comprises an interface for at least one external memory device selected from the group consisting of disks, microcassettes or plug-in memory modules.

9. The electronic piano of claim 1, further comprising a screen for displaying data as it is being stored by said keyboard or by external memory devices operatively connected thereto.

10. The electronic piano of claim 1, further comprising a plurality of LEDs located on at least one of said modules for displaying information.

11. The electronic piano of claim 1, wherein said keyboard can be wound upon itself to form a cylinder.

12. The electronic piano of claim 1, further comprising a female socket adapted to receive signals from a personal stereo through an extension cord linking a stereo headphone output from said personal stereo to said socket, said socket being operatively connected to said preamplifier such that said signals from said personal stereo can be mixed with sounds generated by the keyboard.

* * * * *